United States Patent [19]

Hill

[11] 4,405,121

[45] Sep. 20, 1983

[54] CUTTING AND COLLATING SHEETS OF PAPER, CARD, ETC.

[76] Inventor: James Hill, 116 Silverdale Rd., Sheffield S11 9JL, England

[21] Appl. No.: 299,847

[22] Filed: Sep. 8, 1981

[30] Foreign Application Priority Data

Sep. 5, 1980 [GB] United Kingdom ..... 8028794

[51] Int. Cl.[3] ..... B65H 39/06

[52] U.S. Cl. ..... 270/58

[58] Field of Search ..... 270/1, 4, 5, 21.1, 58; 493/404

[56] References Cited

U.S. PATENT DOCUMENTS 2,879,991 3/1959 Pitner ..... 270/58

3,224,306 12/1965 Hawley ..... 270/58 X

*Primary Examiner*—A. J. Heinz

*Attorney, Agent, or Firm*—Bauer & Amer

[57] ABSTRACT

A method and machine for cutting a sheet (1) into a plurality of pieces (2) and collating them first forms a plurality of slits (3) parallel to one pair of edges (4), and ending short of the other pair of edges (5), next cuts along a plurality of lines (6) parallel to that other pair of edges (5), and with two lines (6) intersecting the ends of the slits (3), then feeds the pieces (2) in the lengthwise direction of the two strips (7) left beyond the cut ends of the slits (3) and allows the two strips (7) to fall away, allows the pieces (D, H, M, R, V, Z) at one end of the rows perpendicular to the direction of feed to drop to a lower level, superimposes a transverse feed on the remaining pieces (2) towards the dropped pieces (D, H, M, R, V, Z), whereby they are dropped in order to form batches (9), and finally allows the batches (9) to fall successively on to a substantially stationary support (33) to form a stack (10) of the pieces (2) in definite order. The machine is capable of completing the method in no more than one-and-a-half seconds, including trimming off initial margins (11) to form the edges (4) parallel to the slits (3) accurately.

12 Claims, 9 Drawing Figures

CUTTING AND COLLATING SHEETS OF PAPER, CARD, ETC.

This invention relates to cutting sheets of paper, or card or other material into a plurality of pieces in a plurality of rows and collating all the pieces from each sheet.

According to one aspect of the present invention, a method of cutting a sheet into a plurality of pieces in a plurality of rows and collating all the cut pieces comprises first forming a plurality of slits extending in spaced relationship parallel to a first pair of opposite edges of the sheet, with all the slits ending short of the other pair of opposite edges of the sheet, next cutting along a plurality of lines parallel to that other pair of opposite edges and with at least two of the lines of cut intersecting the ends of the slits, then feeding the pieces in the lengthwise direction of the two strips left beyond the respective ends of the cut ends of the slits and allowing the two strips to fall away, allowing the pieces at one end of the rows perpendicular to the direction of feed to drop to a level below the remaining pieces, superimposing a transverse feeding on the remaining pieces towards the dropped pieces, whereby the remaining pieces in the respective rows are dropped in order on to the respective initially dropped pieces, and finally allowing the batches of pieces to fall successively on to a substantially stationary support, whereby a stack of the pieces is formed in definite order.

In order to ensure uniformity of dimensions of all the pieces, the sheet may be provided with marginal strips removed by continuous cuts formed simultaneously with the slits ending short of the other pair of opposite edges, the marginal strips being allowed to fall away before forming the cuts parallel to that other pair of edges.

The pieces at one end of the rows perpendicular to the direction of feed of the rows and which are allowed to drop to a level below the remaining pieces may be subjected to the transverse feeding in order to bring them to the positions at which they drop.

According to another aspect of the present invention, a cutting and collating machine comprises a first series of slitting rollers on a common axis, means for interrupting the slitting action of these rollers and means for timing the interruption with the feeding of a sheet perpendicularly to their axis to cause the sheet to receive a plurality of slits extending in spaced relationship parallel to a first pair of opposite edges of the sheet and with all the slits starting and ending short of the other pair of opposite edges of the sheet, means for feeding the sheet at right-angles to the slits to a second series of slitting rollers on a common axis at right-angles to the axis of the first series of slitting rollers, with the end slitting rollers of the second series aligned with the ends of the slits made by the first series of slitting rollers, drive means for both series of slitting rollers, deflecting means for the two strips of each sheet severed by the end slitting rollers of the second series, a conveyor having a forwarding run between leading and return drums respectively adjacent to and remote from the second series of slitting rollers, the forwarding run being at a level below that at which each sheet is fed to the second series of slitting rollers and aligned with the feed means so as to be able to receive one end row of cut pieces of a sheet in line astern, guide means along the forwarding run at or towards the side of the conveyor remote from the remaining rows of cut pieces of sheet, means for driving the conveyor at a speed not less than the peripheral speed of the second series of slitting rollers, transverse feed means for those remaining rows of cut pieces in a plane parallel to and above the plane of the forwarding run of the conveyor but not above the plane of the pieces at the second series of slitting rollers, the direction of feed of the transverse feed means being convergent with the forwarding run of the conveyor in the direction of movement of the latter, drive means for the transverse feed means at a speed such that each row of cut pieces therefrom is deposited in alignment on top of the row of cut pieces on the forwarding run of the conveyor, and a substantially stationary support adjacent to the return drum of the conveyor and below the level of the forwarding run so as to receive therefrom the batches of cut pieces of sheet in succession.

The conveyor may, as described in U.K. patent application No. 2,025,907A or U.S. Pat. No. 4,280,690 consist of a plurality of parallel belts, and the guide means may consist of a rigid strip removably mounted for positioning between any pair of the belts or adjacent the belt remote from the transverse feed means.

Preferably, however, as also described in U.K. patent application No. 2,025,907A or U.S. Pat. No. 4,280,690 the conveyor consists of a single belt, and the guide means consists of a row of balls freely rotatable in a straight cage extending parallel to the conveyor with the balls resting on the forwarding run of the conveyor, the cage being mounted for adjustment of its position transversely of the conveyor belt.

The means for feeding the sheet to the second series of slitting rollers may be a pair or pairs of rollers on axes extending transversely to the conveyor, and may be driven at a slower peripheral speed than the forwarding run of the conveyor, so that the row of pieces deposited on the conveyor in succession have spaces between them.

The transverse feed means preferably consists of upper and lower banks of driven rollers in parallel pairs with their axes inclined to the direction of feeding of the forward feed means and the forwarding run of the conveyor, the banks of rollers having an entry end perpendicular to the conveyor and adjacent the second series of slitting rollers and having an exit side parallel to the conveyor and adjacent thereto.

The first series of slitting rollers is preferably preceded by a pair or pairs of feed rollers which are continuously rotatable to feed a sheet to the first series of slitting rollers when a preceding sheet has cleared the first series of slitting rollers and the interruption of the action of the latter is correctly timed for starting slits short of the leading edge of the sheet. The means for interrupting the slitting action of the first series of slitting rollers may consist of cooperating rollers having two notches each spaced peripherally by a distance equal to the length of the slits to be formed in the sheet, and the means for timing the interruption may be a disc rotatable with the cooperating rollers and provided with a notch forming a "window" for effecting actuation of a proximity switch controlling a clutch and brake drive for the cooperating rollers in conjunction with a photocell detecting the leading edge of each sheet; the cycle time need be no more than one-and-a-half seconds, which is ample for manual feeding of individual sheets in succession to the pair or pairs of feed rollers, or which is very adequate for feed of individual sheets mechanically from a magazine.

The first series of slitting rollers is preferably flanked by non-interrupted slitting rollers, which by a continuous cutting action serve to remove marginal strips of each sheet in order to ensure uniformity of dimensions of all the cut pieces, and deflecting means are provided for the two marginal strips severed by the non-interrupted slitting rollers.

The first series of slitting rollers is preferably followed by a roller table with its rollers rotatable to feed generally in the direction of the second series of slitting rollers. The rollers of the roller table are preferably inclined at an acute angle to the direction of feed towards the second series of slitting rollers, and a guide is provided at the side of the roller table remote from the first series of slitting rollers, with the guide parallel thereto. The guide is adjustable towards and away from the first series of slitting rollers, for setting accurately the alignment of each sheet with the second series of rollers.

Although the roller table may alone serve as the means for feeding each sheet to the second series of slitting rollers, that feed means preferably also comprises or consists of a pair of continuously rotatable feed rollers.

The substantially stationary support adjacent to the return drum of the conveyor may be a table engageable with an intermittent downward drive, with intermittent drive means actuated in response to a trip switch mounted on a rapper for the batches of cut pieces deposited on the table within the embrace of at least two stationary sides of a removable magazine. The rapper may be reciprocable in a fore-and-aft direction with respect to the conveyor, and another rapper is provided for reciprocation at right-angles to the first rapper. The magazine may be removably mounted on a turret on the table, the turret being rotatable to bring the magazine to a loading and unloading station, while another movable magazine is moved into position to receive further batches for cut pieces. Alternatively, the substantially stationary support may be a box having two adjacent sides and a buttom with a notch for entry of a finger of an operative, to remove each stack between a finger and thumb of one hand.

The method of the invention and a preferred embodiment of machine in accordance with the invention will now be described with reference to the accompanying drawings, in which.

Figures 1, 2:
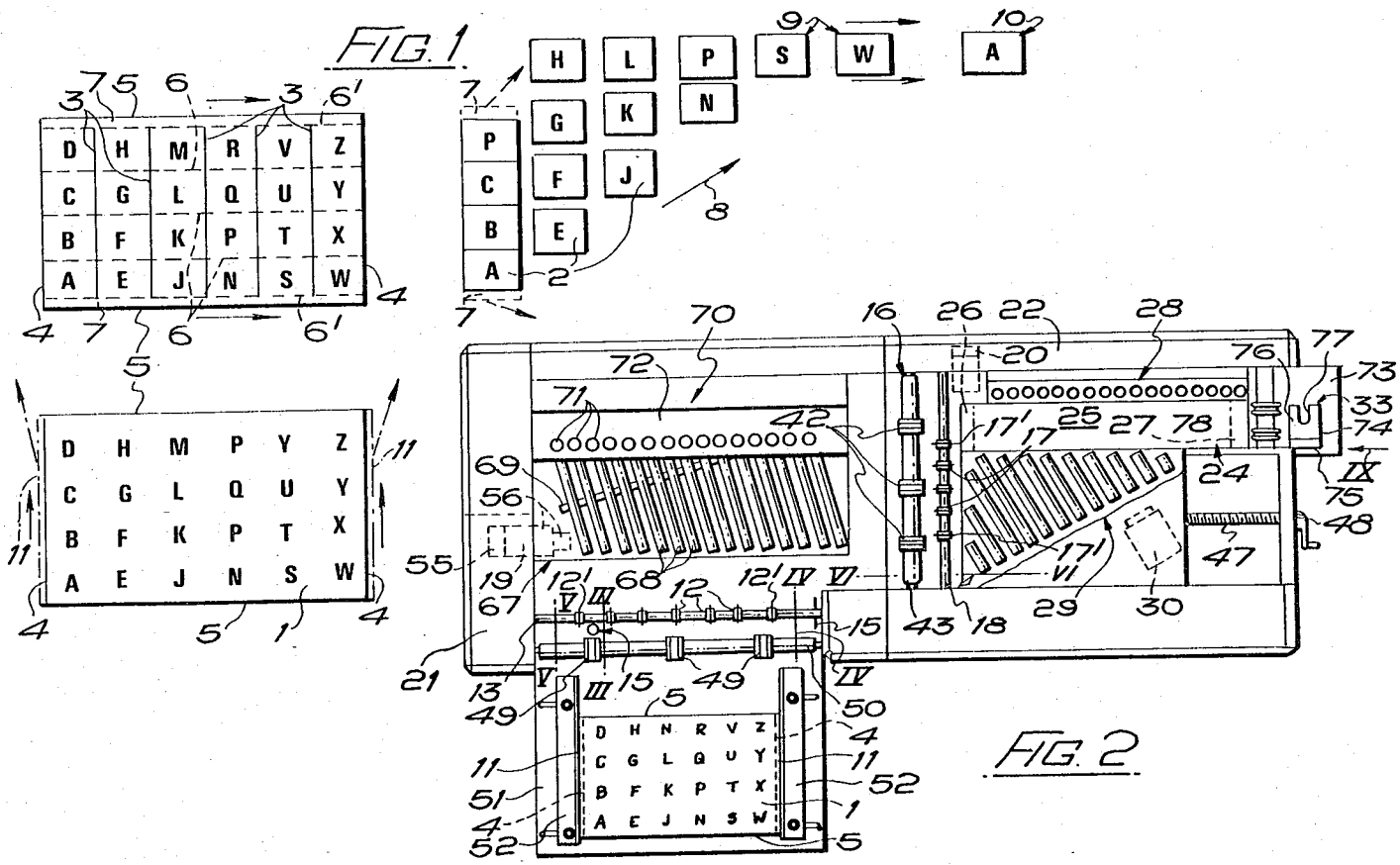
FIG. 1 is a diagrammatic plan illustrating the method of the present invention.
FIG. 2 is a diagrammatic plan of the preferred embodiment of machine in accordance with the invention.
Figure 3:
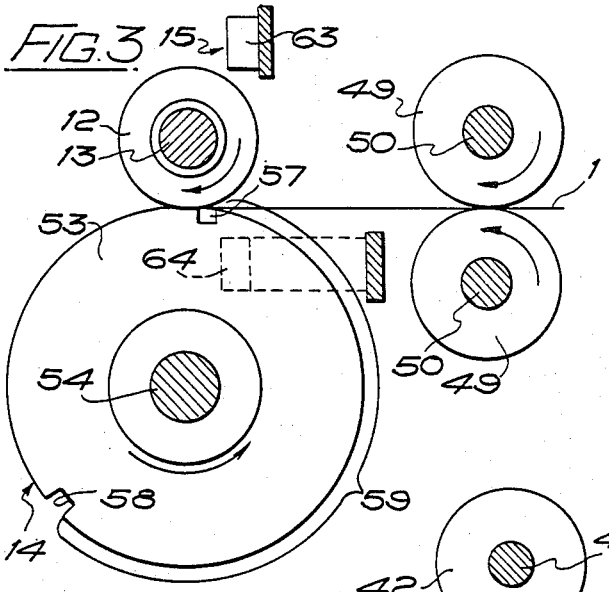
FIGS. 3 to 5 are fragmentary vertical sections from the lines III—III,IV—IV and V—V respectively of FIG. 2 looking from left to right.
Figure 4:
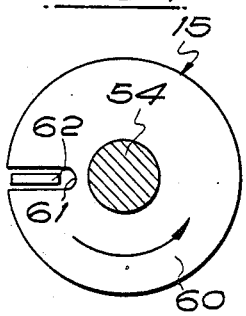
Figure 6:
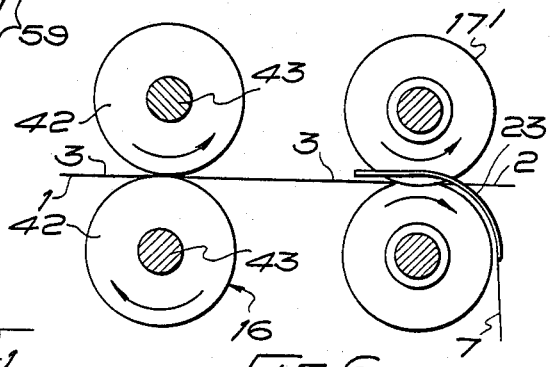
FIG. 6 is a fragmentary vertical section from the line VI—VI of FIG. 2 looking from below.
Figure 5:
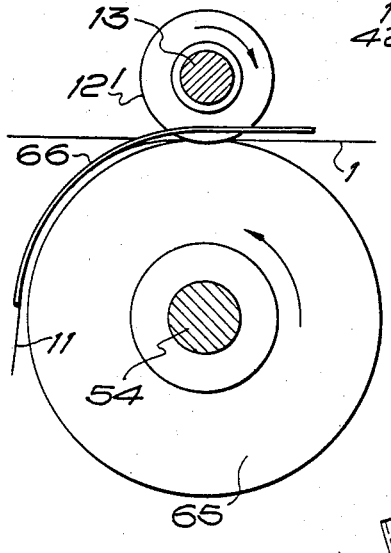
Figure 9:
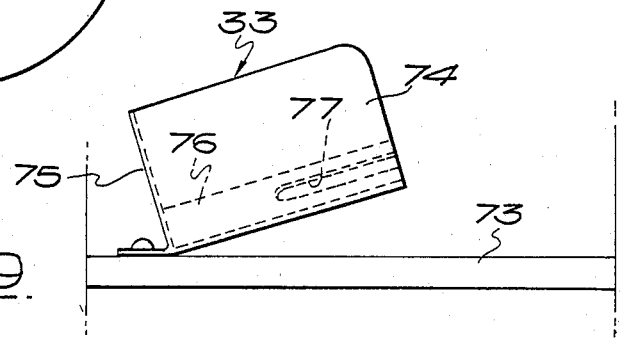
FIG. 9 is a fragmentary elevation in the direction of the arrow IX in FIG. 2.
Figure 7:
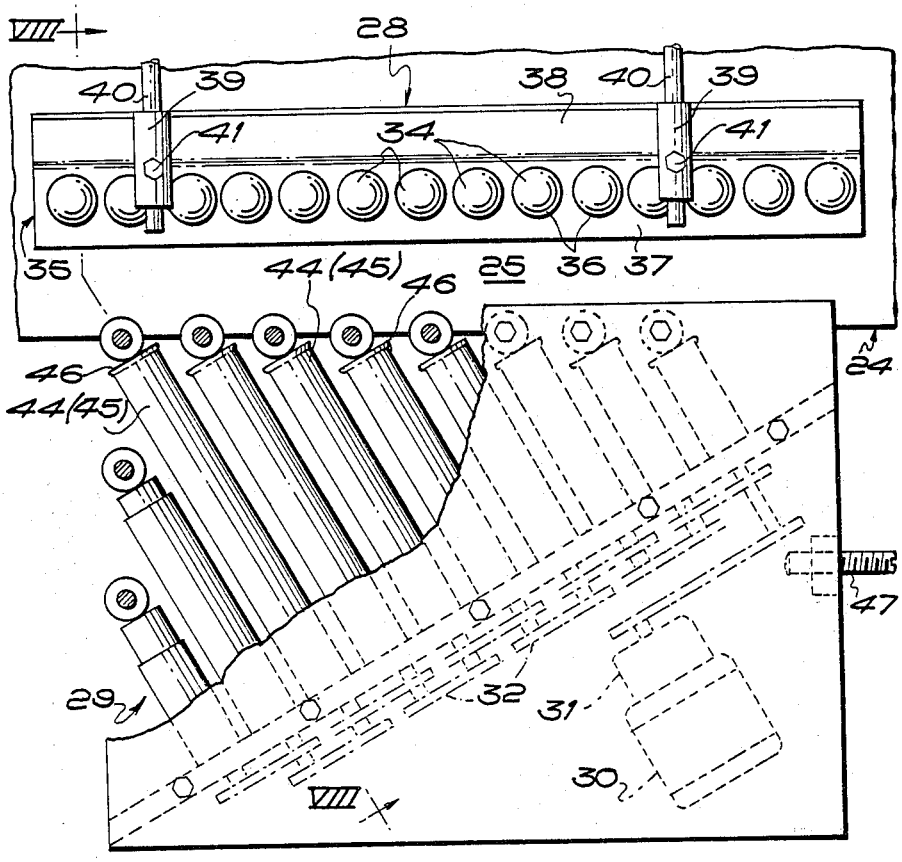
FIG. 7 is a large scale plan of part of FIG. 2.
Figure 8:
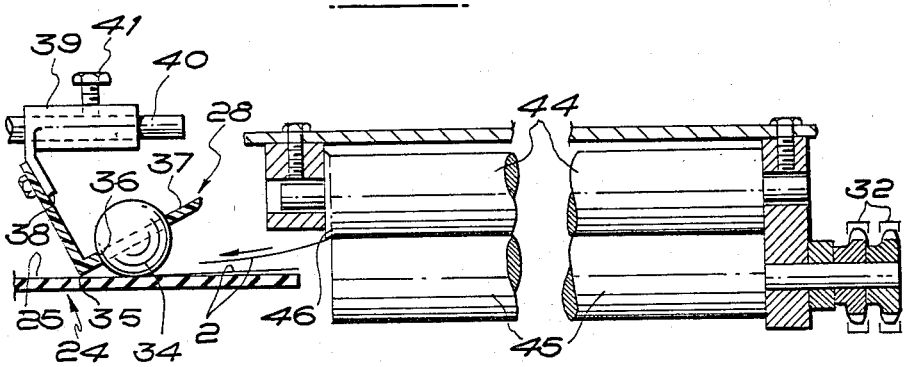
FIG. 8 is a fragmentary vertical section taken on the line VIII—VIII of FIG. 7.

Referring to FIG. 1, the method of cutting a sheet 1 into a plurality of pieces 2 in a plurality of rows and collating all the cut pieces 2 comprises first forming a plurality of slits 3 extending in spaced relationship parallel to a first pair of opposite edges 4 of the sheet 1, with all the slits 3 ending short of the other pair of opposite edges 5 of the sheet, next cutting along a plurality of lines 6 (indicated by broken lines) parallel to that other pair of opposite edges 5 and with at least two of the lines of cut 6' intersecting the ends of the slits 3, then feeding the pieces 2 in the lengthwise direction of the two strips 7 left beyond the respective cut ends of the slits 3 and allowing the two strips 7 to fall away (as indicated in broken lines), allowing the pieces 2 at one end of the rows perpendicular to the direction of feed (i.e., those marked D, H, M, R, V, Z) to drop to a level below the remaining pieces 2, superimposing a transverse feeding on the remaining pieces towards the dropped pieces (the resultant feed direction being indicated by the arrow 8), whereby the remaining pieces in the respective rows are dropped in order on to the respective initially dropped pieces, and finally allowing the batches 9 of pieces to fall successively on to a stationary support, whereby a stack 10 of the pieces 2 is formed in definite order.

In order to ensure uniformity of dimensions of all the pieces 2, the sheet 1 may be provided with marginal strips 11 (indicated by dash-dot lines in FIG. 1) removed by continuous cuts formed (along that would then become the edges 4) simultaneously with the slits 3, the marginal strips 11 being allowed to fall away before forming the cuts 6, 6'.

The pieces allowed to drop to a level below the remaining pieces (i.e., those marked D, H, M, R, V, Z) may be subjected to the transverse feeding in order to bring them to the positions at which they drop, as is the case in FIG. 1.

Referring to FIGS. 2 to 9, the cutting and collating machine comprises a first series of slitting rollers 12 on a common axis 13, means 14 (FIG. 3) for interrupting the slitting action of these rollers and means 15 (FIGS. 2 to 4) for timing the interruption with the feeding of a sheet 1 perpendicularly to their axis to cause the sheet to receive the slits 3 (FIG. 1), means 16 for feeding the sheet at right-angles to the slits 3 to a second series of slitting rollers 17 on a common axis 18 at right angles to the axis 13 of the first series of slitting rollers 12, with the end slitting rollers 17' of the second series aligned with the ends of the slits 3, drive means for both series of slitting rollers consisting of motors 19, 20 respectively and gearboxes 21, 22, deflecting means 23 (FIG. 6) for the two strips 7 of each sheet 1 severed by the end splitting rollers 17' of the second series, a conveyor 24 having a forwarding run 25 between leading and return drums 26, 27 respectively adjacent to and remote from the second series of slitting rollers 17, 17', the forwarding run being at a level below that at which each sheet 1 is fed to the second series of slitting rollers and aligned with the feed means 16 so as to be able to receive one end row of cut pieces 2 of a sheet in line astern, guide means 28 along the forwarding run at or towards the side of the conveyor remote from the remaining rows of cut pieces of sheet, means for driving the conveyor 24 (consisting of the motor 20 and gearbox 22) at a speed not less than the peripheral speed of the second series of slitting rollers, transverse feed means 29 for those remaining rows of cut pieces 2 in a plane parallel to and above the plane of the forwarding run of the conveyor but not above the plane of the pieces at the second series of slitting rollers, the direction of feed of the transverse feed means 29 being convergent with the forwarding run 25 of the conveyor 24 in the direction of movement of the latter, drive means for the transverse feed means (consisting of a motor 30 and gearbox 31, and gearing 32) at a speed such that each row of cut pieces 2 therefrom is deposited in alignment on top of the row of cut pieces on the forwarding run of the conveyor, and a stationary support 33 adjacent to the return drum of the conveyor and below the level of the forwarding run so as to receive therefrom the batches of cut pieces 2 of sheet 1 in succession and form them into a stack 10.

As described in U.K. patent application No. 2,025,907A or U.S. Pat. No. 4,280,690, the conveyor 24 consists of a single belt, and the guide means 28 consists of a row of balls 34 freely rotatable in a straight cage 35 extending parallel to the conveyor with the balls resting on the forwarding run 25 of the conveyor, the cage being mounted for adjustment of its position transversely of the conveyor belt 24. Conveniently, the cage 35 is of L-section and of transparent plastics material, with holes 36 for the balls 34 in one limb 37 and with the other limb 38 secured to brackets 39 slidable on guide bars 40 and securable thereon by screws 41.

The means 16 for feeding the sheet 1 to the second series of slitting rollers 17, 17' consists of pairs of rollers 42 on axes 43 extending transversely to the conveyor 24 and driven (through the gearbox 22) at a slower peripheral speed than the forwarding run 25 of the conveyor, so that the row of pieces deposited on the conveyor in succession have spaces between them (see FIG. 1).

As also described in U.K. patent application No. 2,025,907A and U.S. Pat. No. 4,280,690, the transverse feed means 29 consists of upper and lower banks of driven rollers 44, 45 in parallel pairs with their axes inclined to the direction of feeding of the forwarding run 25 of the conveyor 24, the banks of rollers having an entry end perpendicular to the conveyor and adjacent to the second series of slitting rollers 17, 17' and having an exit side parallel to the conveyor and adjacent thereto. The rollers 45 in the lower bank are driven by the chain drives 32 and are rubber covered, and the rollers 44 in the upper bank rest on the respective lower rollers so as to be driven frictionally thereby. The diameter of the upper rollers 44 increases very slightly and progressively from the entry end to the exit side of the transverse feed means 29, so that the slight tendency towards increase of peripheral speed holds the pieces 2 of sheet taut as they pass through. The upper rollers 44 that extend to the exit side (alongside the conveyor 24) are each provided with an annular lip 46 of very slightly larger diameter overhanging the corresponding end of the respective lower roller 45, so that a piece 2 leaving the transverse feed means 29 is directed downwardly towards the forwarding run 25 of the conveyor 24 as the piece moves towards the guide means 28 and so enters the nip between the balls 34 and the conveyor. The transverse feed means 29 is adjustable in position towards or away from the second series of slitting rollers 17, 17', as by a screw 47 with a handle 48.

The first series of slitting rollers 12 is preceded by pairs of feed rollers 49 continuously rotatable on axes 50 to feed a sheet 1 from a table 51 with transversely adjustable guides 52 to the slitting rollers 12 when a preceding sheet has cleared the slitting rollers 12 and the interruption of the action of the latter is correctly timed for starting the slits 3 short of the leading edge of the sheet. The means 14 for interrupting the slitting action of the first series of slitting rollers 12 consists of cooperating rollers 53 on an axis 54 driven through gearing not shown by the motor 19 under the control of a clutch 55 and a brake 56, each cooperating roller 53 having two notches 57, 58 spaced peripherally by a distance 59 equal to the length of the slits 3. The means 15 for timing the interruption of the slitting action with the feeding of the sheets 1 comprises, on the one hand, a disc 60 on the shaft 54 with a notch 61 for cooperating with a proximity switch or magnetic switch 62, and, on the other hand, a photocell detector 63 with a light source 64 disposed respectively above and below the feed path of the sheets 1 at the approach to the first series of slitting rollers 12, the mode of operation being as follows. When the notch 61 in the disc 60 is in register with the switch 62, the notch 57 in each roller 53 is in the position shown in FIG. 3, the clutch 55 is disengaged from the drive to the shaft 54, and the brake 56 is operative to hold the shaft 54, rollers 53 and disc 60 stationary. When a sheet 1 is fed by the feed rollers 49 to the first series of slitting rollers 12, the leading edge 5 interrupts the beam from the light source 64 to the detector 63 to effect release of the brake 56 and engagement of the clutch 55 with the drive to the shaft 54, which rotates the rollers 53 (and the disc 60) to cooperate with the slitting rollers 12 to make the slits 3, but with the slitting interrupted adjacent the leading and trailing edges 5 of the sheet by the notches 57, 58. After the sheet 1 has left the slitting rollers 12 rotation of the rollers 53 continues until the notch 61 in the disc 60 is again in register with the switch 62, when the clutch 55 is disengaged and the brake 56 re-applied to stop rotation with the notch 57 in each roller 53 again in the position shown in FIG. 3, ready to start the interrupted slitting of the next sheet.

Each sheet 1 is correctly aligned with the first series of slitting rollers 12 by the adjustable guides 52 on the table 51 (which can carry a wad of sheets), and each sheet is fed manually to the feed rollers 49 when the preceding sheet has left the feed rollers 49, but a timed mechanical feed could be provided. The marginal strips 11 (see FIG. 1) of each sheet are cut off by non-interrupted slitting rollers 12' (whose cooperating rollers 65 do not have any notches) flanking the first series of slitting rollers 12, and deflecting means 66 (only one shown in FIG. 5) are provided for the two marginal strips 11 severed by the non-interrupted slitting rollers.

The first series of slitting rollers 12, 12' is followed by a roller table 67, with its rollers 68 rotatable by a belt drive 69 underneath to feed generally in the direction of the second series of slitting rollers. The rollers 68 are inclined at an acute angle to the direction of feed towards the second series of slitting rollers 17, 17', and a guide 70 is provided at the side of the roller table 67 remote from the first series of slitting rollers 12, 12', which guide consists of balls 71 in a cage 72 and resting on the rollers 68. The guide 70 is adjustable towards and away from the first series of slitting rollers 12, 12', for setting accurately the alignment of each sheet 1 with the second series of rollers 17, 17'.

The stationary support 33 (FIGS. 2 and 9) receiving the batches 9 of cut pieces 2 to form a stack 10 is a box on a fixed table 73 beyond the return drum 27 of the conveyor 24, the box having two adjacent sides 74, 75 and a bottom 76 with a notch 77 for entry of a finger of an operative, to remove each stack 10 between a finger and thumb of one hand. Pairs of driven outfeed rollers 78 are provided between the conveyor 24 and the box 33.

What I claim is:

1. A method of cutting a discrete rectangular sheet into a plurality of pieces in a plurality of rows and collating all the cut pieces comprising first forming a plurality of slits extending in spaced relationship parallel to a first pair of opposite edges of the sheet, with all the slits ending short of at least one of the other pair of opposite edges of the sheet, to form at least one continuous extending, uncut edge portion, said slits dividing the sheet into separate, elongated strips attached together by the uncut edge portion, next cutting along a plurality of lines parallel to that other pair of opposite edges and with at least one of the lines of cut intersecting the ends of the slits adjacent the at least one uncut edge portion to separate said at least one uncut edge portion from said strips, then feeding the pieces in the lengthwise direction of the uncut edge portion left beyond the respective ends of the cut ends of the slits and allowing said uncut edge portion to fall away, thereafter allowing the pieces at one end of the rows perpendicular to the direction of feed to drop to a level below the remaining pieces, transversely feeding the remaining pieces towards the dropped pieces, and superimposing the remaining pieces in the respective rows in order on to the respective previously dropped pieces, and finally allowing the batches of pieces to fall successively on to a substantially stationary support, whereby a stack of the pieces is formed in definite order.

2. A method as in claim 1, wherein the sheet is provided with marginal strips removed by continuous cuts formed simultaneously with the slits ending short of the other pair of opposite edges, the marginal strips being allowed to fall away before forming the cuts parallel to that other pair of edges.

3. A method as in claim 1 or claim 2, wherein pieces at one end of the rows perpendicular to the direction of feed of the rows and which are allowed to drop to a level below the remaining pieces are subjected to the transverse feeding in order to bring them to the positions at which they drop.

4. A cutting and collating machine comprising a first series of slitting rollers on a common axis, means for interrupting the slitting action of these rollers and means for timing the interruption with the feeding of a sheet having four sides perpendicularly to their axis to cause the sheet to receive a plurality of slits extending in spaced relationship parallel to a first pair of opposite edges of the sheet and with all the slits starting and ending short of the other pair of opposite edges of the sheet, means for feeding the sheet at right-angles to the slits to a second series of slitting rollers, a second series of slitting rollers mounted on a common axis at right-angles to the axis of the first series of slitting rollers, with the end ones of said slitting rollers of the second series aligned with the ends of the slits made by the first series of slitting rollers, drive means for both series of slitting rollers, deflecting means for the two strips of each sheet severed by the end slitting rollers of the second series, a conveyor having a forwarding run between leading and return drums respectively adjacent to and remote from the second series of slitting rollers, the forwarding run being at a level below that at which each sheet is fed to the second series of slitting rollers and aligned with the feed means so as to be able to receive one end row of cut pieces of a sheet in line astern, guide means along the forwarding run at or towards the side of the conveyor remote from the remaining rows of cut pieces of sheet, means for driving the conveyor at a speed not less than the peripheral speed of the second series of slitting rollers, transverse feed means for those remaining rows of cut pieces in a plane parallel to and above the plane of the forwarding run of the conveyor but not above the plane of the pieces at the second series of slitting rollers, the direction of feed of the transverse feed means being convergent with the forwarding run of the conveyor in the direction of movement of the latter, drive means for the transverse feed means at a speed such that each row of cut pieces therefrom is deposited in alignment on top of the row of cut pieces on the forwarding run of the conveyor, and a substantially stationary support adjacent to the return drum of the conveyor and below the level of the forwarding run so as to receive therefrom the batches of cut pieces of sheet in succession.

5. A machine as in claim 4, wherein the conveyor consists of a single belt, and the guide means consists of a row of balls freely rotatable in a straight cage extending parallel to the conveyor with the balls resting on the forwarding run of conveyor, the cage being mounted for adjustment of its position transversely of the conveyor belt.

6. A machine as in claim 4, wherein the means for feeding the sheet to the second series of slitting rollers is a pair or pairs of rollers on axes extending transversely to the conveyor.

7. A machine as in claim 4, wherein the first series of slitting rollers is preceded by a pair or pairs of feed rollers which are continuously rotatable to feed a sheet to the first series of slitting rollers when a preceding sheet has cleared the first series of slitting rollers and the interruption of the action of the latter is correctly timed for starting slits short of the leading edge of the sheet.

8. A machine as in claim 7, wherein the means for interrupting the slitting action of the first series of slitting rollers consists of cooperating rollers having two notches each spaced peripherally by a distance equal to the length of the slits to be formed in the sheet, and wherein the means for timing the interruption is a disc rotatable with the corresponding rollers and provided with a notch forming a "window" for effecting actuation of a proximity switch controlling a clutch and brake drive for the cooperating rollers in conjunction with a photocell detecting the leading edge of each sheet.

9. A machine as in claim 7 or claim 8, wherein the first series of slitting rollers is flanked by non-interrupted slitting rollers, which by a continuous cutting action serve to remove marginal strips of each sheet in order to ensure uniformity of dimensions of all the cut pieces, and deflecting means are provided for the two marginal strips severed by the non-interrupted slitting rollers.

10. A machine as in claim 4, wherein the first series of slitting rollers is followed by a roller table with its rollers rotatable to feed generally in the direction of the second series of slitting rollers.

11. A machine as in claim 10, wherein the rollers of the roller table are inclined at an acute angle of the direction of feed towards the second series of slitting rollers, and a guide is provided at the side of the roller table remote from the first series of slitting rollers, with the guide parallel thereto, the guide being adjustable towards and away from the first series of slitting rollers, for setting accurately the alignment of each sheet with the second series of rollers.

12. A machine as in claim 4 wherein the substantially stationary support is a box having two adjacent sides and a buttom with a notch for entry of a finger of an operative to remove each stack between a finger and thumb of one hand.

* * * * *